United States Patent [19]

Bouchard

[11] Patent Number: 5,001,394

[45] Date of Patent: Mar. 19, 1991

[54] GLOW DISCHARGE LAMP CONTAINING THERMAL SWITCH FOR PRODUCING DOUBLE HOT SPOTS ON CATHODE

[75] Inventor: Andre C. Bouchard, Peabody, Mass.

[73] Assignee: GTE Products Corporation, Danvers, Mass.

[21] Appl. No.: 397,230

[22] Filed: Aug. 23, 1989

[51] Int. Cl.[5] ..... H01J 17/00; H01J 61/64

[52] U.S. Cl. ..... 313/619; 313/601; 313/631; 313/491; 315/75

[58] Field of Search ..... 313/491, 601, 619, 631; 315/73, 74, 75, 56, 59

[56] References Cited

U.S. PATENT DOCUMENTS

| | | | |
|---|---|---|---|
| 2,337,993 | 12/1943 | Hall, Jr. et al. | 315/278 |
| 2,341,990 | 2/1944 | Inmann et al. | 313/619 |
| 2,351,305 | 6/1944 | Thayer | 315/56 |
| 4,616,156 | 10/1986 | Roche et al. | 315/74 |
| 4,647,893 | 3/1987 | Sindlinger | 315/73 |

OTHER PUBLICATIONS

K. Yuhara, F. Nakaya, and N. Aoike, "High Frequency Operation Producing Double Hot Spots on Electrodes for Fluorescent Lamps," pp. 181-190, Journal of the Illuminating Engineering Society—Summer 1987.

*Primary Examiner*—Donald J. Yusko
*Assistant Examiner*—Diab Hamadi
*Attorney, Agent, or Firm*—Carlo S. Bessone

[57] ABSTRACT

A preheat-type fluorescent lamp, such as a negative glow discharge lamp, includes a cathode contained within an evelope and supported by a pair of lead-in wires. A thermal switch is located within the evelope shunting the cathode and electrically coupled to the supporting lead-in wires. Closure of the thermal switch during lamp operation produces a double hot spot on the shunted cathode. As a result, the cathode temperature is lowered sufficiently causing an improvement in the lumen maintenance and life of the lamp.

6 Claims, 1 Drawing Sheet

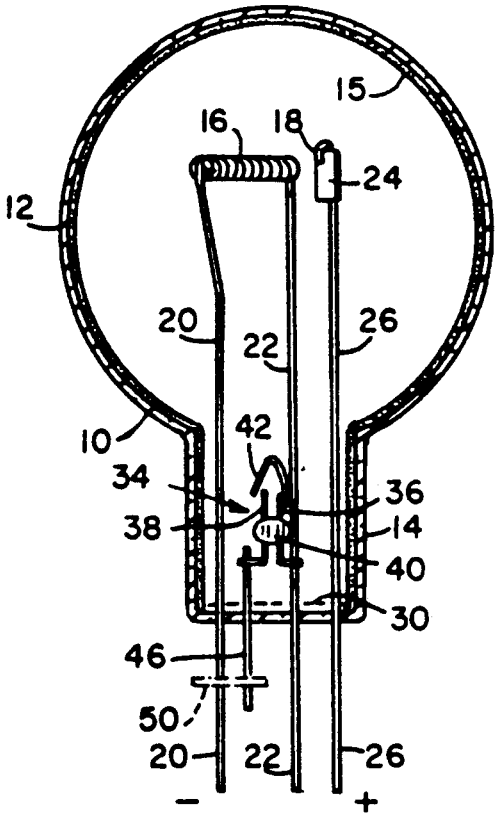
15
16
18
24
12
20
22
26
10
42
34
36
38
14
40
30
46
50
20
22
26
−
+

GLOW DISCHARGE LAMP CONTAINING THERMAL SWITCH FOR PRODUCING DOUBLE HOT SPOTS ON CATHODE

CROSS-REFERENCE TO A RELATED APPLICATION

This application discloses, but does not claim, inventions which are claimed in U.S. Ser. No. 07/397,539 filed concurrently herewith and assigned to the Assignee of this application.

FIELD OF THE INVENTION

This invention relates in general to a fluorescent lamp and pertains, more particularly, to a preheat-type negative glow discharge lamp containing a thermal switch.

BACKGROUND OF THE INVENTION

A negative glow discharge lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. At least one of the electrodes is in the form of an electron emissive cathode. In a d.c. operated preheat-type lamp having an anode and cathode, the cathode is preheated to electron emitting temperature for several seconds. Current flows between the electrodes after a certain potential is applied to the electrodes, commonly referred to as the breakdown voltage. An elementary explanation of the phenomenon is that the gas between the electrodes becomes ionized at a certain voltage, conducts current and emit ultraviolet radiation. The ultraviolet radiation is converted to visible radiation by means of a phosphor layer disposed on the inner surface of the lamp envelope. It is understood that what is meant by a negative glow discharge lamp, as distinguished from a positive column lamp, is one in which the anode is positioned so that no appreciable positive column is developed within the discharge.

During operation of a fluorescent lamp, it is advantageous to produce a double hot spot on the cathode so as to lower the electrode temperature. The reduced electrode temperature has been found to cause an improvement in the lumen maintenance and life of the lamp. U.S. Pat. No. 2,337,993, which issued to Hall, Jr., et al on Dec. 28, 1943, discloses a lamp comprising a plurality of cathodes arranged and combined in a manner to provide a plurality of emissive or hot spots on each cathode of each electrode. This patent requires special circuitry to operate a lamp wherein each end electrode has a plurality of cathodes.

An article entitled "High Frequency Operation Producing Double Hot Spots on Electrodes for Fluorescent Lamps" in Journal of the Illuminating Engineering Society (Summer 1987) by Yuhara et al lists various methods for producing a double hot spot. The article details, in particular, circuits wherein the frequencies of the lamp current and the filament voltage are different.

Thermal switches have been used in rapid-start and preheat-type fluorescent lamp for various purposes. For example, U.S. Pat. No. 4,616,156, which issued to Roche et al on Oct. 7, 1986 discloses a rapid-start lamp containing a thermal switch. The thermal switch is connected in series with the cathode for discontinuing heater current upon operation of the fluorescent lamp to reduce energy requirements. U.S. Pat. No. 2,351,305, which issued to Thayer on June 13, 1944, discloses a preheat-type fluorescent lamp having a thermal switch located within the lamp base structure. The thermal switch is connected in series with the cathode filament to provide preheating current to the filament prior to lamp ignition.

SUMMARY OF THE INVENTION

It is, therefore, an object of the present invention to obviate the disadvantages of the prior art.

It is another object of the invention to provide an enhanced preheat-type fluorescent lamp.

It is still another object of the invention to provide a fluorescent lamp having improved lumen maintenance and life.

It is a further object of the invention to provide an alternative technique for producing a plurality of hot spots on the cathode.

It is still another object of the invention to provide a technique for producing a plurality of hot spots on the cathode which is relatively easy to implement.

It is another object of the invention to provide a method for producing a plurality of hot spots on the cathode which does not require special circuitry or a lamp having a plurality of cathodes.

These objects are accomplished in one aspect of the invention by the provision of a preheat-type discharge lamp, such as a glow discharge lamp, including a light-transmitting envelope containing an ionizable medium. A phosphor coating is disposed on the inner surface of the envelope. A pair of electrodes is disposed within the envelope. First and second lead-in wires support one of the electrodes. A third lead-in wire has a first portion within the envelope and a second portion outside the envelope. The second portion of the third lead-in wire is coupled to the first lead-in wire. A thermal switch is located within the envelope shunting at least one on the electrodes and electrically connected to the second and third lead-in wires. A double hot spot is produced on the shunted electrode during lamp operation as a result of the closure of the thermal switch.

In accordance with further teachings of the present invention, the envelope includes a bulbous region and a neck region and the thermal switch is located within the neck region of the envelope. Preferably, the thermal switch includes a bimetallic element.

In accordance with further aspects of the present invention, the second portion of the third lead-in wire is coupled to the first lead-in wire by means of a shunting wire.

In accordance with still further teachings of the present invention, the second portion of the third lead-in wire is connected directly to the first lead-in wire.

The objects are accomplished in another aspect of the invention by the provision of a glow discharge lamp including a light-transmitting envelope containing an ionizable medium and having a bulbous region and a neck region. A phosphor coating is disposed on the inner surface of the envelope. A pair of electrodes is disposed within the bulbous portion of the envelope. First and second lead-in wires support one of the electrodes. A third lead-in wire has a first portion within the envelope and a second portion outside the envelope. The second portion of the third lead-in wire is coupled to the first lead-in wire. A thermal switch is located within the neck region of the envelope shunting at least one of the electrodes and electrically connected to the second and third lead-in wires. A double hot spot is produced on the shunted electrode during lamp operation as a result of the closure of the thermal switch.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWING

The invention will become more readily apparent from the following exemplary description in connection with the accompanying drawing, wherein:

The sole FIGURE represents an elevated cross-sectional view of a negative glow discharge lamp according to the present invention.

BEST MODE FOR CARRYING OUT THE INVENTION

For a better understanding of the present invention, together with other and further objects, advantages and capabilities thereof, reference is made to the following disclosure and appended claims in connection with the above-described drawings.

Referring to the drawing, the sole FIGURE illustrates a fluorescent lamp, such as a negative glow discharge lamp, including a light-transmitting envelope 10 that has a bulbous region 12 and a neck region 14. Within bulbous region 12 of envelope 10 there is disposed a pair of electrodes such as a cathode electrode 16 and an anode electrode 18. The cathode electrode may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time. Lead-in wires 20 and 22 support cathode electrode 16 and provide electrical power thereto. Anode electrode 18 comprises a strip 24 of molybdenum foil supported by a single lead-in wire 26. Lead-in wires 20, 22, 26 are hermetically sealed such as by means of a wafer stem assembly 30 that closes the bottom neck region 14 of the lamp envelope as illustrated in the sole FIGURE. The lead-in wires may be rod-like of say 20–30 mil diameter.

The envelope contains an ionizable medium that emits ultraviolet radiation upon excitation. This ionizable medium may contain mercury and a noble gas or a mixture of noble gases. In one embodiment, the lamp may be filled with a noble gas mixture at 3 torr. This mixture may be 99.5% neon and 0.5% argon at 1.5 torr with approximately 30 milligrams of mercury. The inner surface of lamp envelope 10 has a phosphor coating 15 which emits visible light upon absorption of ultraviolet radiation.

In accordance with the teachings of the instant invention, the glow discharge lamp further includes a thermal switch 34 electrically coupled across cathode 16. Thermal switch 34 is normally open at room temperature. Heat generated by the discharge during lamp operation causes closure of the thermal switch. The switch closure produces a hot spot at each end of the cathode. As a result, the electrode temperature is lowered sufficiently to cause an improvement in the lumen maintenance and life of the lamp.

Thermal switch 34 includes electrical leads 36, 38 secured together by a glass bead 40. One end of electrical lead 36 is connected to lead-in wire 22. Further included in thermal switch 34 is a bimetallic element 42 having one end thereof connected (e.g., by welding) to the other end of lead 36. Bimetallic element 42 may be in the form of a U and have a free end proximate one end of lead 38. Bimetallic element 42 consists of two strips of metal having different linear coefficients of expansion welded together. The side of higher coefficient of expansion is on the outside curve of the U so that the bimetallic element closes in and engages lead 38 when the bimetallic element is heated. The other end of lead 38 of thermal switch 34 is secured to or formed from a lead-in wire 46 which is sealed in and passes through wafer stem assembly 30.

Preferably, the thermal switch is located in the neck region of the envelope near the base of the lamp as illustrated in the sole FIGURE. In this location, the thermal switch attenuates very little of the emitted light.

During lamp manufacturing, the cathode is activated by connecting an a.c. supply to lead-in wires 20 and 22 for an amount of time sufficient to convert the carbonate material on the cathode to oxides. Following the activation process, lead-in wire 46 is coupled to lead-in wire 20 by means of a permanent shunting wire 50 welded thereacross. Shunting wire 50 is attached after the activation process since the temperature of the process, which may exceed 300 degrees Celsius, causes thermal switch 34 to close and otherwise prevent normal cathode breakdown. In an alternative embodiment, lead-in wire 46 is welded or mechanically attached (i.e., pigtailing) directly to lead-in wire 20 external to the lamp envelope following the activation process.

As to starting and operating the glow discharge lamp illustrated in the sole FIGURE, lead-in wire 26 is connected to the positive terminal of a d.c. power supply (not shown). Lead-in wire 20, which is shown electrically coupled to thermal switch 34 by means of shunting wire 50 and lead-in 46, is connected to the negative terminal of the power supply. To start the lamp, preheat current is supplied to cathode 16 by momentarily connecting together lead-in wires 22 and 26. A conventional glow discharge starter may be secured to lead-in wire 22 and 26 to facilitate the preheating and starting. Upon ignition, a glow discharge is produced between anode 18 and cathode 16. After a predetermined amount of time, such as approximately 3 to 5 seconds, the heat from the discharge (which may reach 100 degrees Celsius) causes bimetallic element 42 to contact lead 38 to electrically connect together lead-in wires 20 and 22 creating a short circuit across cathode 16. After the lamp is extinguished, the bimetallic element of the thermal switch cools within about 3 seconds and resets to a normally-open condition. The closure and reset properties of the thermal switch may be altered by composition of the switch material and placement of the switch within the lamp.

The thermal switch may have a configuration different from that illustrated in the sole FIGURE. For example, the thermal switch may be enclosed within a glass bottle. Moreover, the thermal switch need not include a pair of electrical leads and/or a glass bulb. For example, one end of the bimetallic element may be secured directly to one of the lead-in wires while the other end of the bimetallic element is spaced from the other lead-in wire.

As a result of the thermal switch of the present invention, a plurality of hot spots are produced on the cathode during lamp operation. The filament or cathode temperature was reduced from 1200 degrees Celsius to 1040 degrees Celsius. The lower temperature reduces barium evaporation of the lamp cathode and prolongs lamp life.

While a d.c. operated glow discharge lamp is depicted in the sole FIGURE, it is readily apparent to those skilled in the art that the teachings of the present invention may be applied to other types of lamps, such as fluorescent arc discharge lamps having electrodes respectively disposed at opposing ends of an elongated envelope. The lamps may be operated either a.c or d.c. For a.c. discharge lamps having a pair of electrodes in the form of tungsten exciter coils, each electrode is preferably shunted by a thermal switch.

There has thus been shown and described a preheat-type fluorescent lamp containing a thermal switch for producing a plurality of hot spots on the cathode during lamp operation. The lamp provides improved lumen maintenance and life. The invention is relatively simply to implement and does not require the use of complex ballasting circuitry.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A preheat-type discharge lamp comprising:

a light-transmitting envelope containing an ionizable medium;

a phosphor coating disposed on the inner surface of said envelope;

a pair of electrodes disposed within said envelope;

first and second lead-in wires supporting one of said electrodes;

a third lead-in wire having a first portion within said envelope and a second portion outside said envelope, said second portion of said third lead-in wire coupled to said first lead-in wire; and a thermal switch located within said envelope shunting at least said one of said electrodes and electrically connected to said second and third lead-in wires whereby a double hot spot is produced on said shunted electrode during lamp operation as a result of the closure of said thermal switch.

2. The preheat-type discharge lamp of claim 1 wherein said envelope includes a bulbous region and a neck region, said thermal switch being located within said neck region of said envelope.

3. The preheat-type discharge lamp of claim 1 wherein said second portion of said third lead-in wire is coupled to said first lead-in wire by means of a shunting wire.

4. The preheat-type discharge lamp of claim 1 wherein said second portion of said third lead-in is connected directly to said first lead-in wire.

5. The preheat-type discharge lamp of claim 1 wherein said thermal switch includes a bimetallic element.

6. A glow discharge lamp comprising:

a light-transmitting envelope containing an ionizable medium and having a bulbous region and a neck region;

a phosphor coating disposed on the inner surface of said envelope;

a pair of electrodes disposed within said bulbous portion of said envelope;

first and second lead-in wires supporting one of said electrodes;

a third lead-in wire having a first portion within said envelope and a second portion outside said envelope, said second portion of the third lead-in wire coupled to said first lead-in wire; and a thermal switch located within said neck region of said envelope shunting at least said one of said electrodes and electrically connected to said second and third lead-in wires whereby a double hot spot is produced on said shunted electrode during lamp operation as a result of the closure of said thermal switch.

* * * * *